US007819282B2

(12) United States Patent
Israel

(10) Patent No.: US 7,819,282 B2
(45) Date of Patent: Oct. 26, 2010

(54) NEWSPAPER VENDING MACHINE

(76) Inventor: Benjamin Israel, P.O. Box 3354, Maple Glen, PA (US) 19002

( * ) Notice: Subject to any disclaimer, the term of this patent is extended or adjusted under 35 U.S.C. 154(b) by 1338 days.

(21) Appl. No.: 11/104,176

(22) Filed: Apr. 11, 2005

(65) Prior Publication Data

US 2005/0224512 A1 Oct. 13, 2005

Related U.S. Application Data

(60) Provisional application No. 60/561,961, filed on Apr. 12, 2004.

(51) Int. Cl.
*G07F 11/00* (2006.01)

(52) U.S. Cl. ..... 221/195; 221/194; 221/37; 221/45; 221/155; 221/209; 221/152

(58) Field of Classification Search ..... 221/1–312 C
See application file for complete search history.

(56) References Cited

U.S. PATENT DOCUMENTS

| | | | | | |
|---|---|---|---|---|---|
| 1,108,164 | A | * | 8/1914 | Glines | 221/155 |
| 1,886,694 | A | | 11/1932 | Kelly | |
| 3,042,250 | A | | 7/1962 | Watlington | |
| 3,114,475 | A | | 12/1963 | Etes | |
| 3,708,087 | A | * | 1/1973 | Schonthal | 221/110 |
| 3,768,695 | A | | 10/1973 | Pearson | |
| 3,912,124 | A | * | 10/1975 | Pinkerton | 221/298 |
| 4,043,484 | A | | 8/1977 | Vanjo | |
| 4,067,477 | A | | 1/1978 | Chalabian | |
| 4,140,242 | A | | 2/1979 | Muller et al. | |
| 4,174,047 | A | | 11/1979 | Owens | |
| 4,569,461 | A | | 2/1986 | Orr | |
| 4,583,658 | A | | 4/1986 | Israel | |
| 4,889,221 | A | * | 12/1989 | Schlumpf | 194/345 |
| 5,000,346 | A | * | 3/1991 | Moore et al. | 221/215 |
| 5,178,299 | A | | 1/1993 | Mundt | |
| 5,205,437 | A | | 4/1993 | Elder et al. | |
| 5,492,213 | A | * | 2/1996 | Kim | 194/237 |
| 5,791,511 | A | | 8/1998 | Lowing | |
| 5,921,436 | A | | 7/1999 | Lowing | |
| 5,954,227 | A | * | 9/1999 | Moore et al. | 221/103 |
| 5,996,840 | A | | 12/1999 | Serduke | |
| 6,279,719 | B1 | * | 8/2001 | Israel | 194/248 |
| 6,467,649 | B1 | * | 10/2002 | Ullman et al. | 221/192 |

* cited by examiner

*Primary Examiner*—Gene Crawford
*Assistant Examiner*—Michael K Collins
(74) *Attorney, Agent, or Firm*—Drinker Biddle & Reath LLP

(57) ABSTRACT

A newspaper vending machine includes a dispensing sled and an elevator supported by a frame within a housing. The elevator includes a base slidable between a rearward position, for loading a stack of newspapers, and a forward position. The dispensing sled engages the newspaper stack and is translatable between upper and lower positions to dispense the periodicals from an exit area. An actuation arm projects outwardly from a front panel for engagement by a user and is translated along a substantially vertical pathway as the dispensing sled is moved between its upper and lower positions. The frame of the vending machine is translatably supported on rails for movement between a retracted condition in which the frame is located within the interior and an extended condition in which the frame extends beyond a front end of the housing.

8 Claims, 20 Drawing Sheets

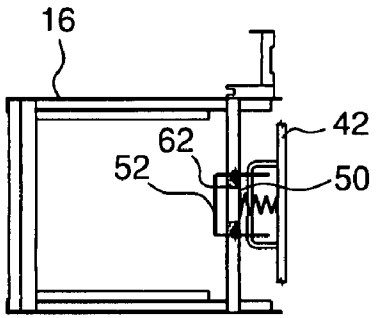
FIG. 7A
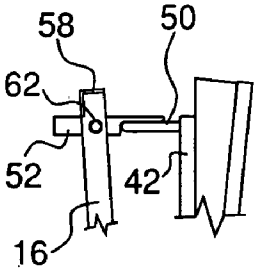
FIG. 7B
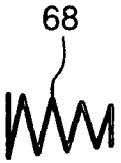
FIG. 7C
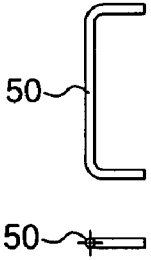
FIG. 7D
FIG. 7E
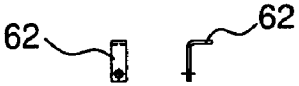
FIG. 7F
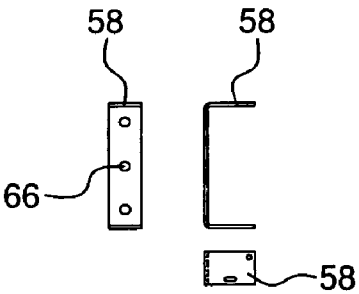
FIG. 7G

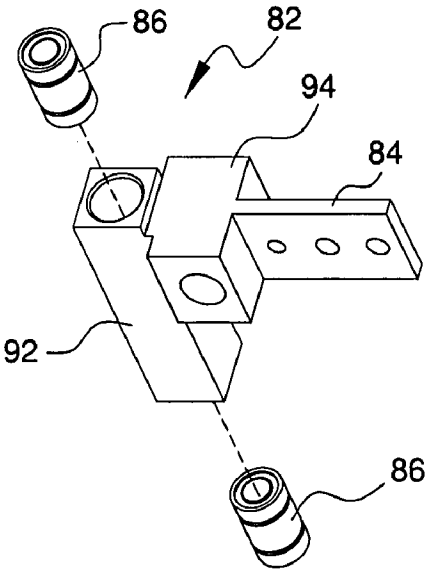
FIG. 14A
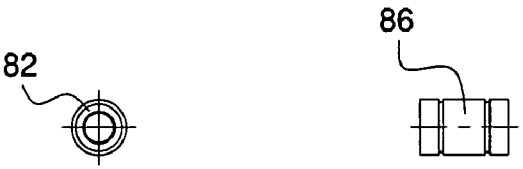
FIG. 14B
FIG. 14C
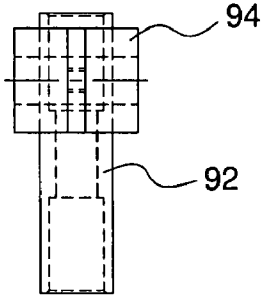
FIG. 14F
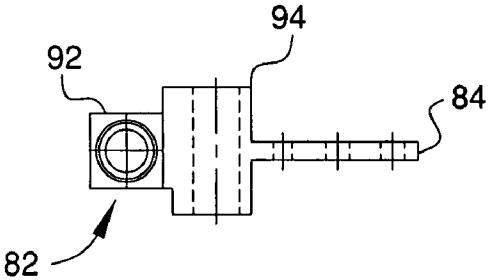
FIG. 14D
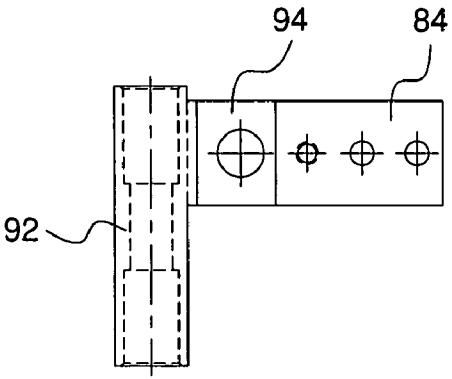
FIG. 14E

NEWSPAPER VENDING MACHINE

RELATED APPLICATION

This application is related to and claims priority from U.S. Provisional Application No. 60/561,691, filed Apr. 12, 2004, which is incorporated herein by reference in its entirety.

FIELD OF THE INVENTION

The present invention relates to vending machines for dispensing publications such as newspapers and other periodicals.

BACKGROUND OF THE INVENTION

Vending machines for dispensing publications such as newspapers are known. U.S. Pat. No. 6,279,719 to Israel discloses a vending machine including a housing containing a spring-driven elevator for advancing a stack of newspapers to be dispensed one at a time by a dispensing assembly.

The dispensing assembly of the '719 patent includes a sled having wheels contained within vertical guide rails for translation between upper and lower positions. An actuation arm is pivotably connected to a rear wall of the housing and to the sled through a linkage for driving the sled along the guide rails during pivoting of the actuation arm. Contact fingers extend from the sled to engage a newspaper at the leading end of the stack of newspapers. The downward movement of the sled directs the engaged newspaper towards a discharge area at the bottom of the housing.

The vending machine of the '719 patent includes an arm locking mechanism having a rod that contacts the actuation arm to prevent pivoting of the actuation arm unless a requisite amount of coins are deposited. The rod is pivotably connected to the top of the housing and is prevented from movement by a locking latch. A solenoid releases a cam member that provides for pivoting of the latch to an unlocked position, thereby permitting movement of the arm-locking rod.

The vending machine of the '719 patent also includes latched blocking levers preventing a newspaper from downward movement unless the requisite amount of coins are deposited. Downward movement of the sled results in unlatching of the blocking levers to allow for removal of the newspaper.

The vending machine of the '719 patent further includes a display frame in which a copy of the publication being dispensed is placed for display through a transparent panel. The transparent panel is secured to a front door hingedly connected to the housing. Door latches secured to the front door engage pivoting lock arms to prevent the front door from being opened until all newspapers have been dispensed from the elevator by the dispensing mechanism. The contact fingers of the dispensing assembly engage a linkage system when the elevator is empty to release the lock arms from the front door latches. Compression springs located between the front door and the housing cause the front door to open a small amount signaling a use to open the front door using a handle to retrieve the display copy.

Known vending machines include an adjustable exit plate for varying the width of an exit path in response to changes in the thickness of the newspapers being dispensed. As shown in FIG. 5A of the '719 patent, for example, a threaded hand wheel connected to the exit plate engages a support plate such that, depending on the direction that the hand wheel is turned, the exit plate is moved towards or away from the support plate.

The vending machine of the '719 patent includes a service door in the side of the housing. The service door provides access to the interior of the housing for loading newspapers onto the elevator. An operator forces the spring-loaded base of the elevator toward the back wall and engages an elevator lock to hold the base near the back wall while newspapers are being placed onto the elevator.

SUMMARY OF THE INVENTION

According to one aspect of the invention, a vending machine for dispensing a periodical such as a newspaper comprises a housing including a top wall, a bottom wall, a back wall and side walls. The vending machine also comprises a display including a door hingedly connected to a front panel. The display door includes a transparent panel for displaying a copy of the periodical being dispensed by the vending machine.

The vending machine also comprises an elevator and a dispensing assembly. The elevator includes elongated rods secured to a frame and a base supported on the rods. The elevator base is slidable between a rearward position, for loading a stack of periodicals, and a forward position. The dispensing assembly includes a dispensing sled translatable with respect to the frame between an upper position and a lower position. The dispensing assembly is adapted to engage a forwardly located one of the periodicals of the stack of periodicals loaded onto the elevator for dispensing the periodical from an exit area of the vending machine.

The vending machine further comprises an actuation arm attached to the dispensing sled such that the arm is preferably translated along a substantially vertical path as the dispensing sled is moved between its upper and lower positions. The actuation arm projects outwardly from the front panel to provide for actuation of the dispensing assembly by a user of the vending machine. The vending machine also comprises an actuation arm locking mechanism engaging the actuation arm. The arm locking mechanism includes locked and unlocked conditions for respectively disabling and enabling the actuation of the dispensing assembly. The vending machine further comprises a door locking assembly engaging the display door. The door locking assembly is adapted to prevent access to the display copy of the periodical until the last periodical of the stack of periodicals is dispensed from the elevator.

Preferably, the vending machine includes a linear slide assembly having a substantially vertical guide rod and at least one linear bearing slidably received on the guide rod. The at least one linear bearing is located within a bore defined by a slide body. Preferably, the actuation arm and the dispensing sled are attached to the linear slide assembly.

According to another aspect of the invention, a vending machine for dispensing a periodical such as a newspaper comprises a housing and a carriage frame translatably supported by the housing. The carriage frame is movable with respect to the housing between a retracted position in which the carriage frame is contained within an interior of the housing and an extended position in which at least a portion of the carriage frame extends beyond a front end of the housing.

Preferably, the vending machine also comprises a pair of rails secured to the housing and at least one roller rotatably secured to each of the rails. The carriage frame engages the rollers on the rails for translation with respect to the housing. The vending machine also preferably comprises a retainer wire attached at opposite ends to the housing and to the base of an elevator supported by the carriage frame.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown. In the drawings:

FIGS. 7A through 7G are views of the display door latching mechanism of FIGS. 6A and 6B and its components.

FIGS. 14A through 14F are views showing a linear slide assembly of the vending machine of FIGS. 11 through 13.

DETAILED DESCRIPTION OF THE INVENTION

Figure 1:
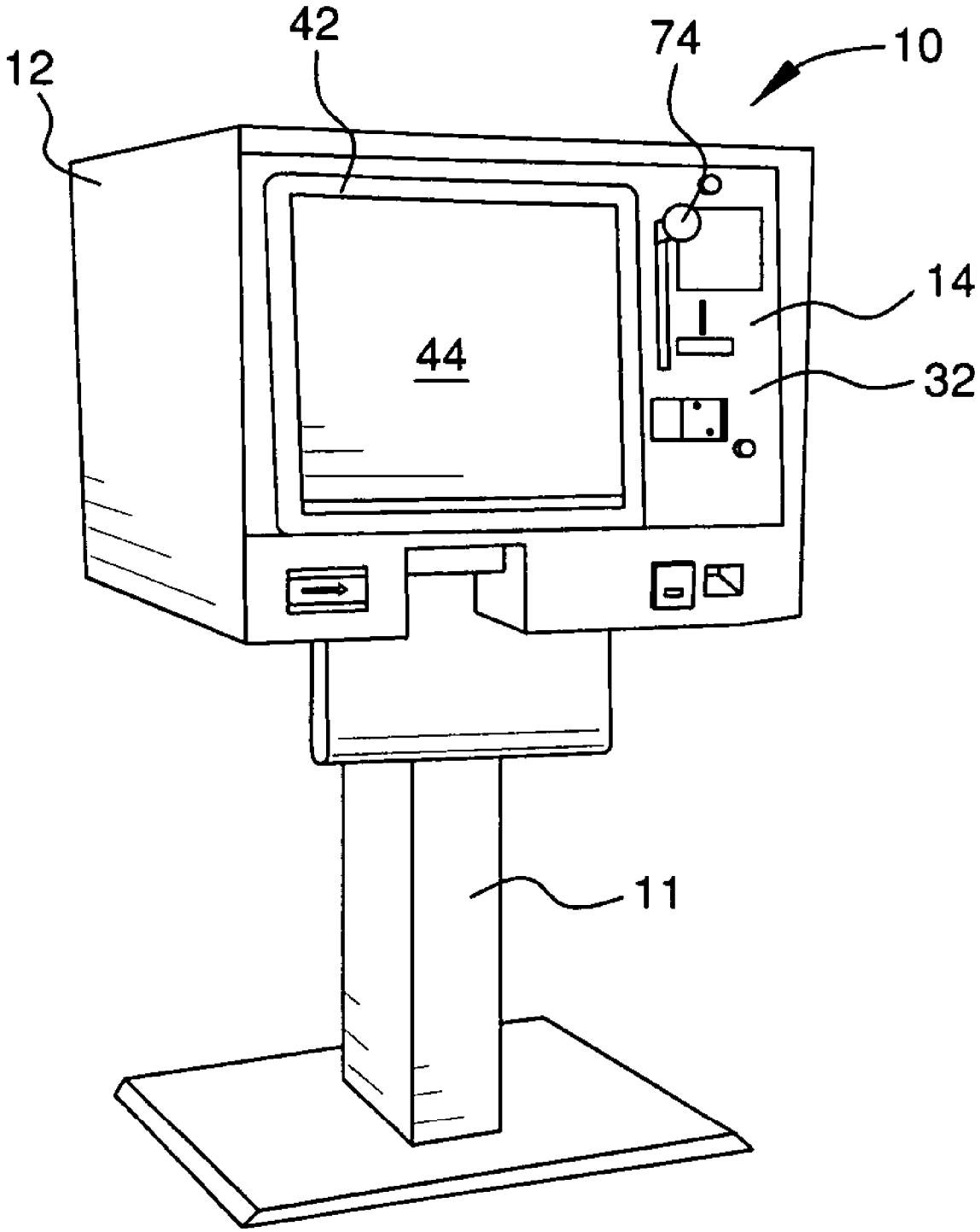
FIG. 1 is a perspective view of a newspaper vending machine according to the invention.
Figure 2:
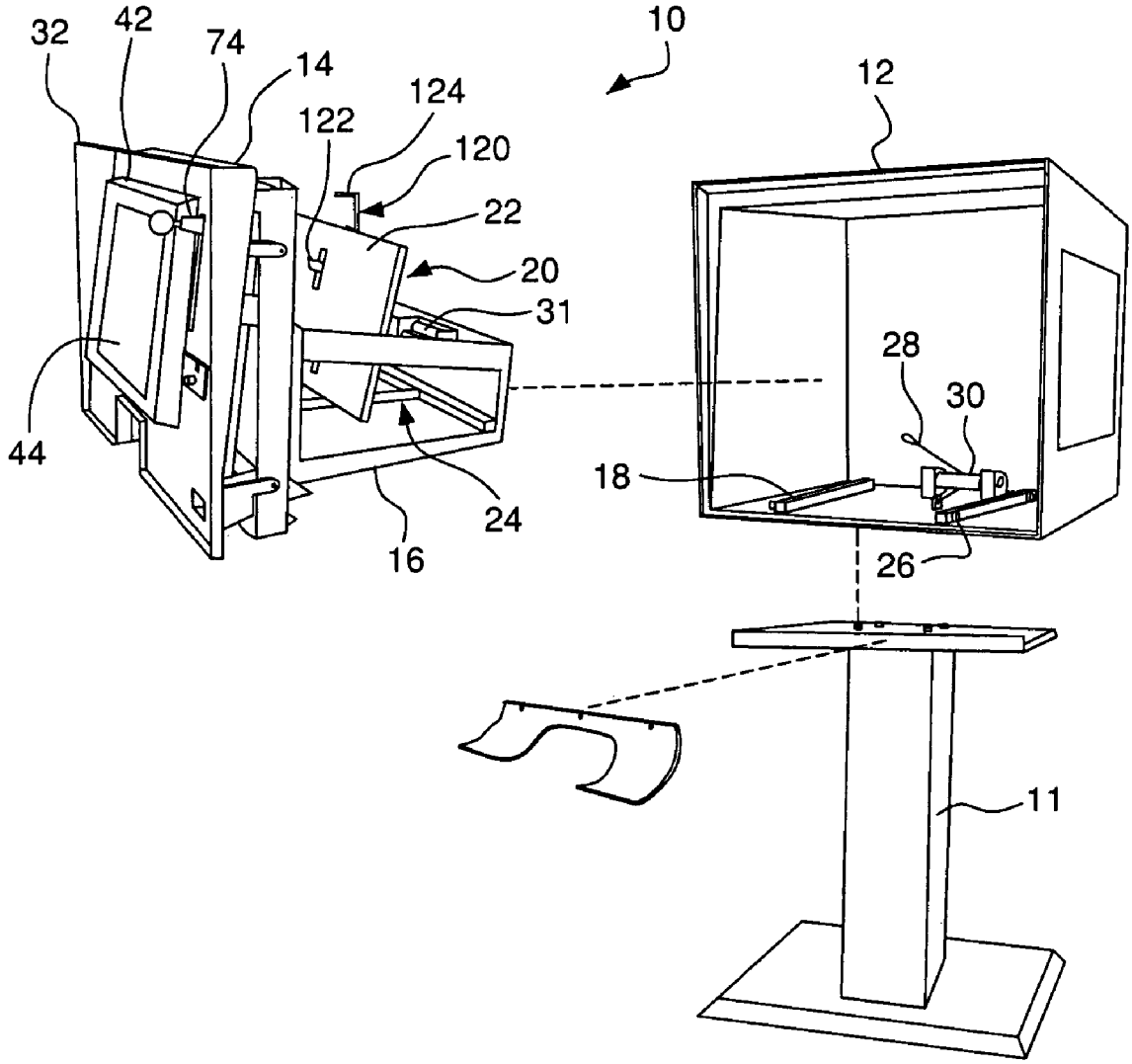
FIG. 2 is an exploded perspective view of a newspaper vending machine according to the invention.

Referring to the drawings, where like numerals identify like elements, there is shown in FIGS. 1 and 2 a newspaper vending machine 10 according to the invention. The newspaper vending machine 10 includes a housing 12 having top, bottom, side and back walls forming an enclosure that receives a vending assembly 14. The housing 12 is preferably supported on a stand 11 to position the housing 12, and the vending assembly 14 that it houses, at a convenient height for operation by a user. The newspaper vending machine 10 shares certain features in common with the newspaper vending machine disclosed in U.S. Pat. No. 6,279,719, which is incorporated by reference in its entirety. The following description focuses on modifications and improvements that have been made to the vending machine of the '719 patent.

Figure 3B:
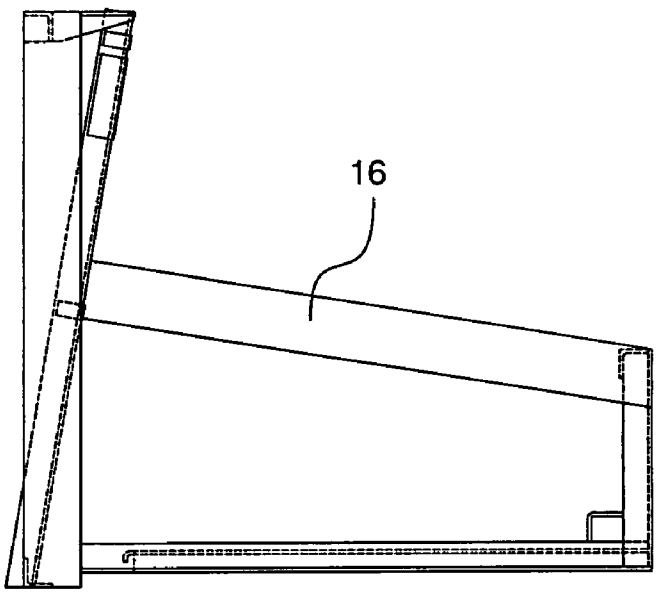
FIGS. 3A and 3B are respectively perspective and side views of a carriage frame of the newspaper vending machine of FIGS. 1 and 2.
Figure 3A:
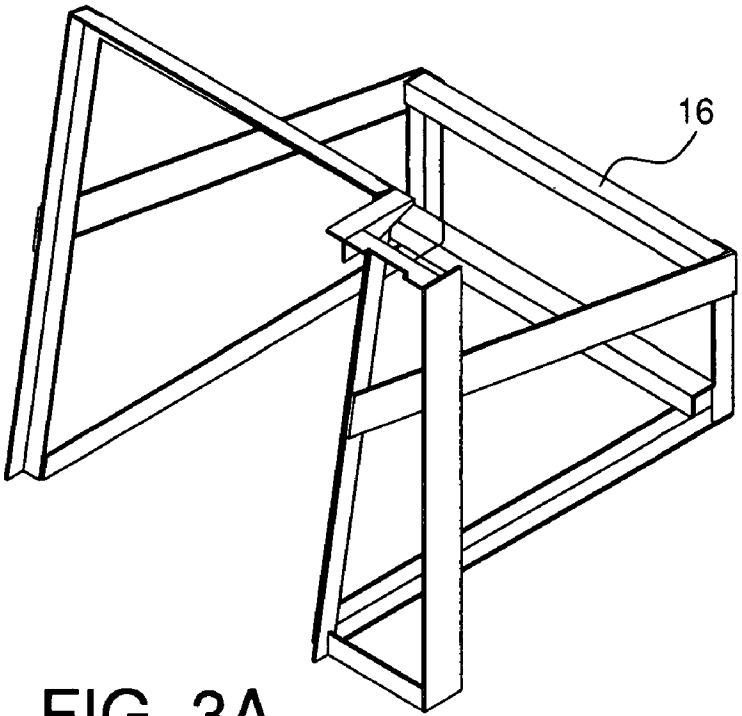

Referring to FIGS. 2 and 3, the vending assembly 14 of newspaper vending machine 10 includes a carriage frame 16. The carriage frame 16 engages rails 18 secured to the bottom wall of housing 12 for translation of the carriage frame 16 with respect to the housing 12. The translatable support of carriage frame 16 provides for movement of the carriage frame 16, in the manner of a drawer, between a closed position shown in FIG. 1 and an opened position in which a portion of the carriage frame 16 is extended from the housing 12.

The vending assembly 14 includes an elevator 20, having a base 22 translatably mounted on guide shafts 24 secured to the carriage frame 16. The elevator 20 supports a stack of newspapers, or other periodicals, to be dispensed from the vending machine 10 as described below in greater detail. The above-described movement of the carriage frame 16 to the opened drawer position facilitates loading of the periodicals onto the elevator 20 by an operator when the vending machine 10 has been emptied. As shown in FIG. 2, the vending machine 10 includes rollers 26 secured to the rails 18 to facilitate movement of the carriage frame 16 between opened and closed positions.

Figure 4A:
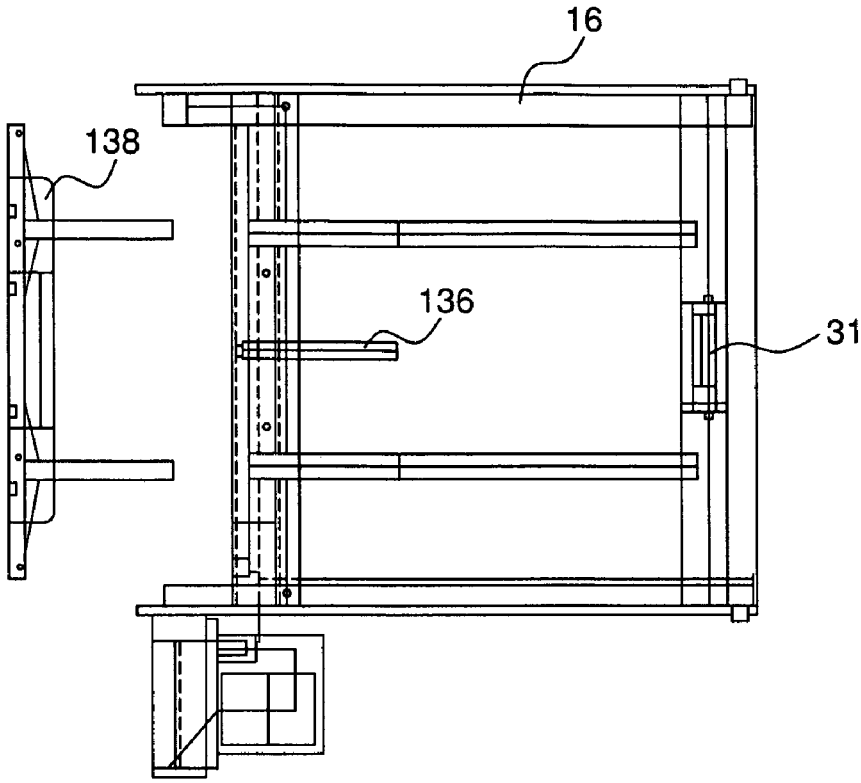
FIGS. 4A and 4B are respectively top and side views showing the carriage frame and a portion of the vending apparatus of the newspaper vending machine of FIGS. 1 and 2.
Figure 4B:
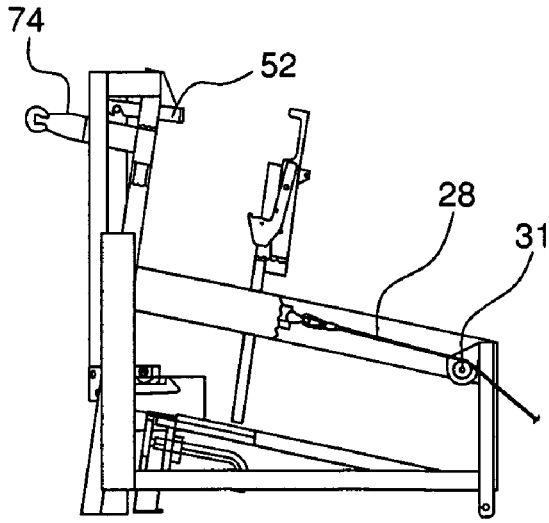
Figure 5A:
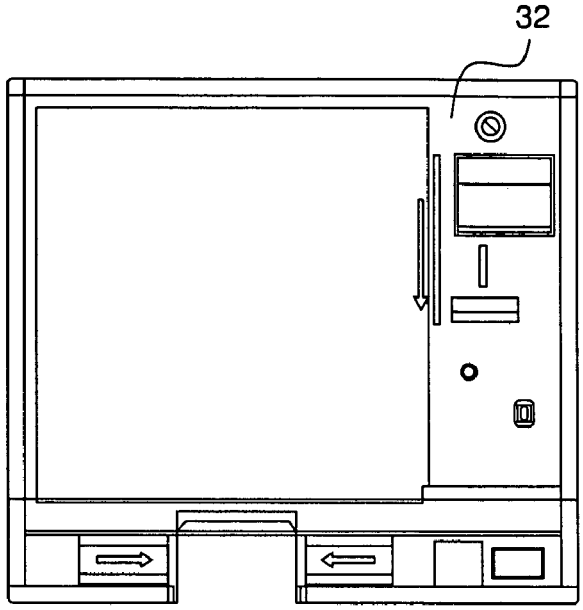
FIGS. 5A through 5C are respectively front, rear and side views of a front panel of the newspaper vending machine of FIGS. 1 and 2.
Figure 5B:
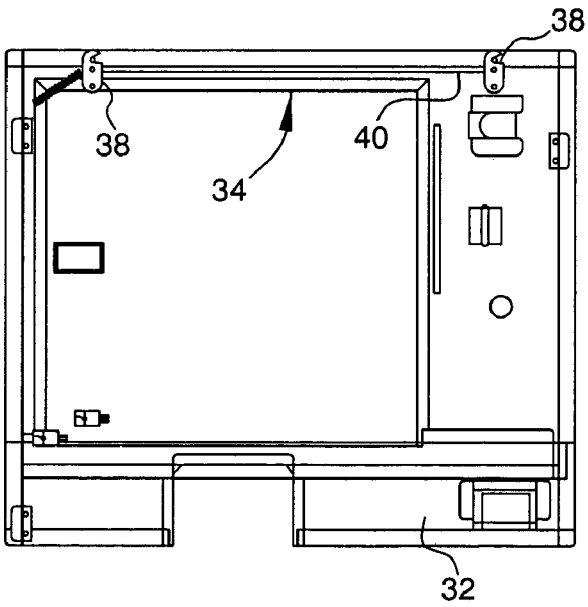
Figure 5C:
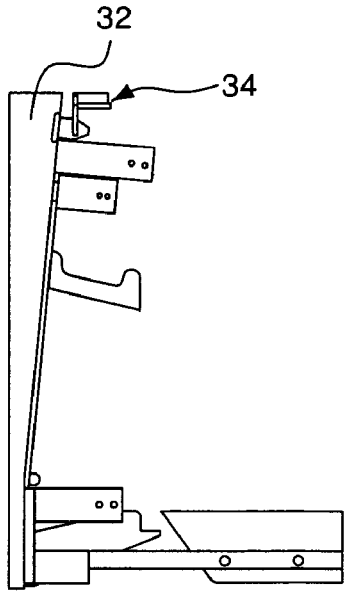

The vending machine 10 includes a retainer wire 28 having opposite ends attached to the elevator base (see FIG. 4B) and the bottom wall of the housing 12 (see FIG. 2). The vending machine 10 also includes rollers 30, 31 respectively mounted to the bottom wall of the housing 12 and the carriage frame 16. As shown in FIGS. 2 and 4B, the retainer wire 28 extends over each of the rollers 30, 31. The attachment between the housing 12 and the base 22 of elevator 20, which is provided by the retainer wire 28, functions to hold the elevator base 22 and restrict its movement with respect to the housing 12 when the carriage frame 16 is moved to the opened drawer position. As a result, the elevator base 22 is automatically retracted to the back end of the carriage frame 16 as the carriage frame 16 is moved to the open drawer position. The drawer-like opening of carriage frame 16, and the automatic retraction of the elevator base 22, provides an improvement over the '719 vending machine in which an operator was required to open a side door, force the elevator base rearwardly, and actuate a locking mechanism to hold the elevator in place. While a wire is used to hold the base in place as the drawer is extended, it should be readily apparent that other devices, such as linkages, can be used in the present invention.

Referring to FIGS. 2, and 5A through 5C, the newspaper vending machine 10 includes a front panel 32 preferably attached to the carriage frame 16. Attachment of the front panel 32 to the carriage frame 12 provides for the above-described drawer-like movement of the carriage frame 16 between closed and opened positions to facilitate loading of newspapers onto the elevator 20. The front panel 32 includes a panel lock assembly 34 including a pair of pivotably mounted latches 38 connected to each other by an elongated linkage member 40. The latches 38 are adapted to engage the housing 12 in a locked position to prevent movement of the carriage frame 16 to the opened drawer position. The lock assembly 34 includes a key-operated mechanism 36 connected to one of latches 38 for pivoting the latches 38 to an unlocked position.

Figure 6A:
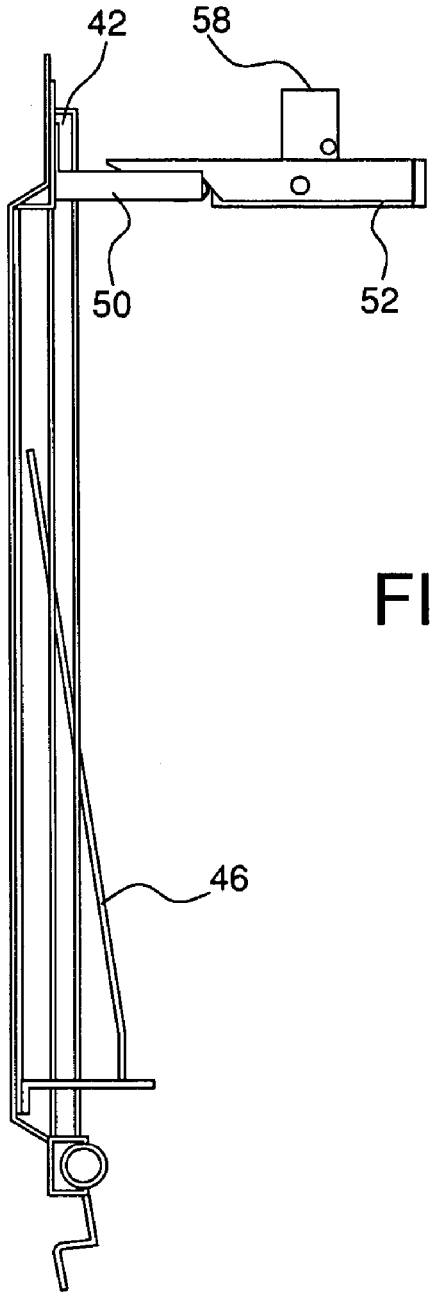
FIG. 6A is a side view of a display and a display door latching mechanism of the newspaper vending machine of FIGS. 1 and 2.
Figure 6B:
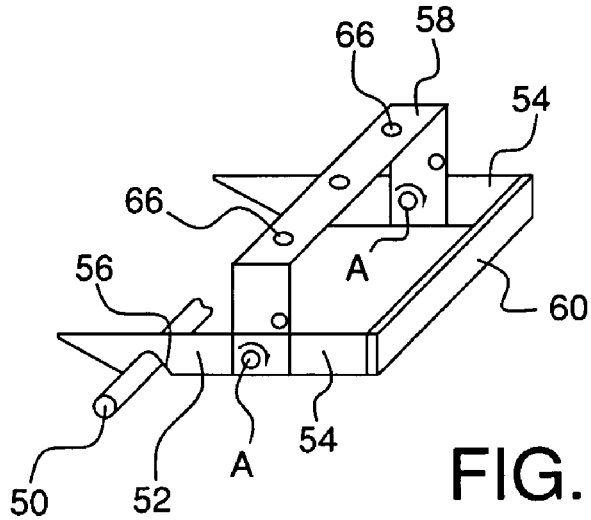
FIG. 6B is a perspective view of a portion of the display door latching mechanism of FIG. 6A.
Figure 8:
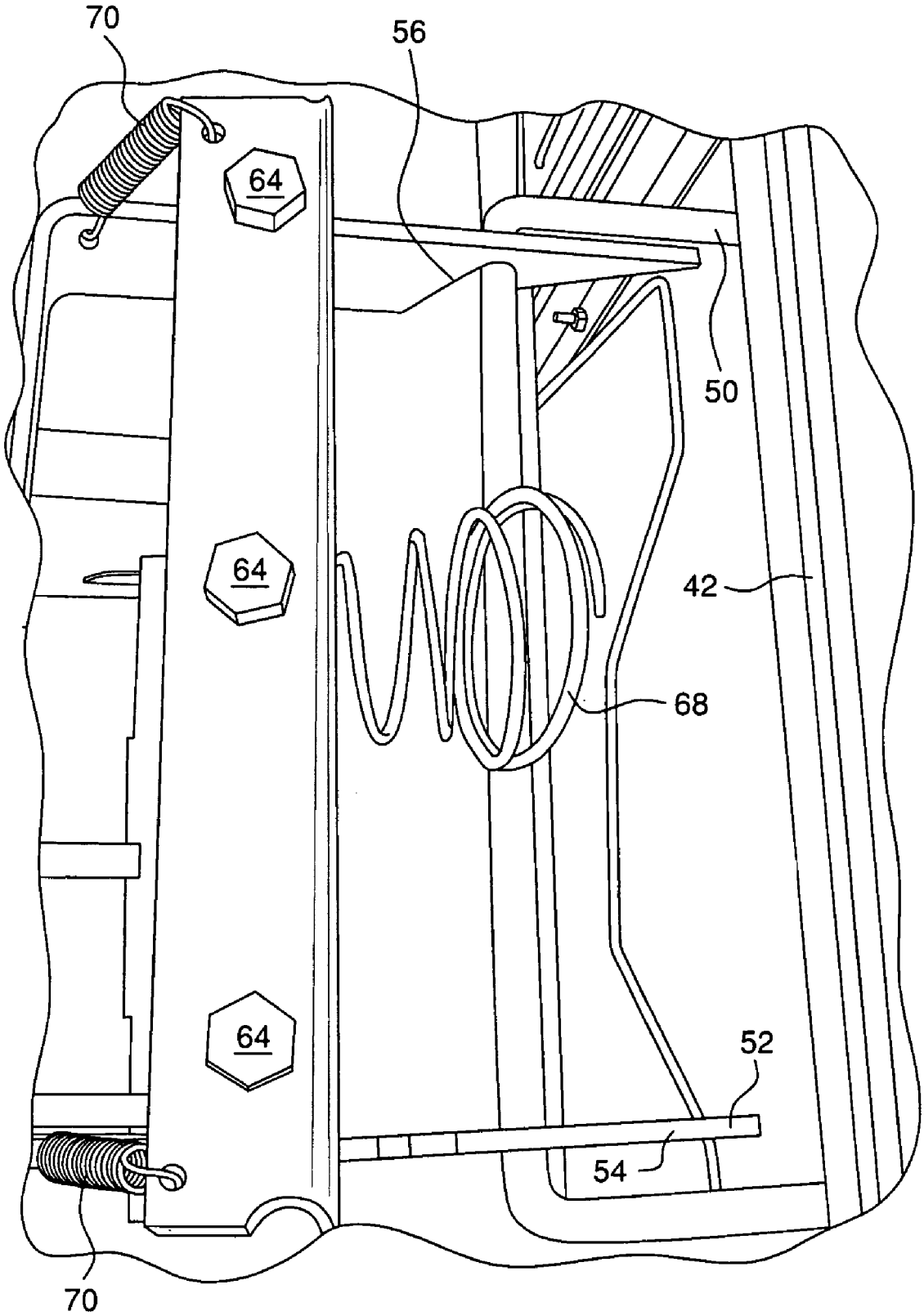
FIG. 8 is a partial top perspective view of the vending apparatus of the newspaper vending machine of FIGS. 1 and 2 including the display door latching mechanism of FIGS. 6A through 7G.
Figure 9:
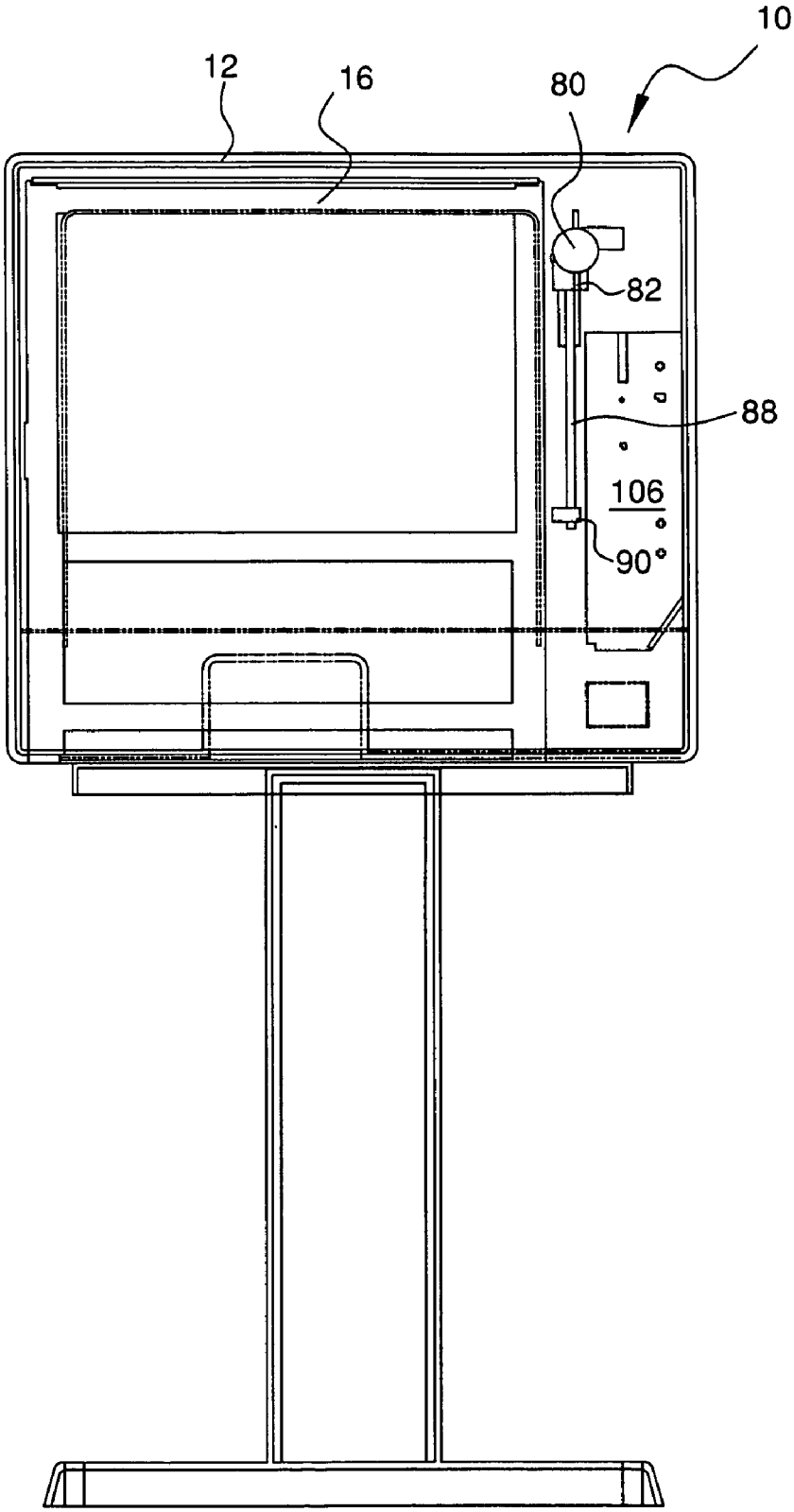
FIG. 9 is a front view of a newspaper vending machine according to the invention.
Figure 10:
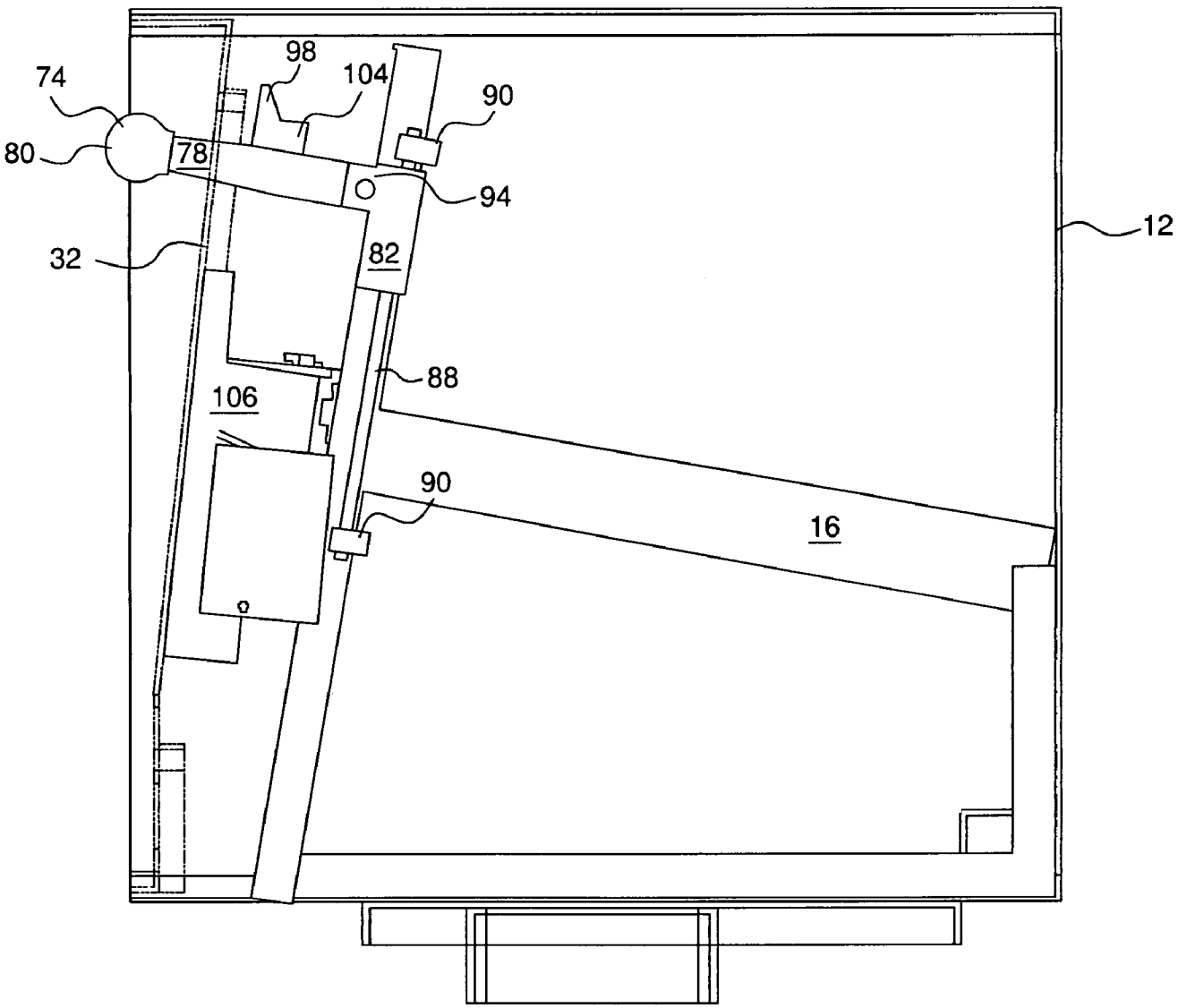
FIG. 10 is a side view of the newspaper vending machine of FIG. 9, with the side wall of the housing removed and a portion of the vending apparatus shown in phantom for clarity of view.
Figure 11:
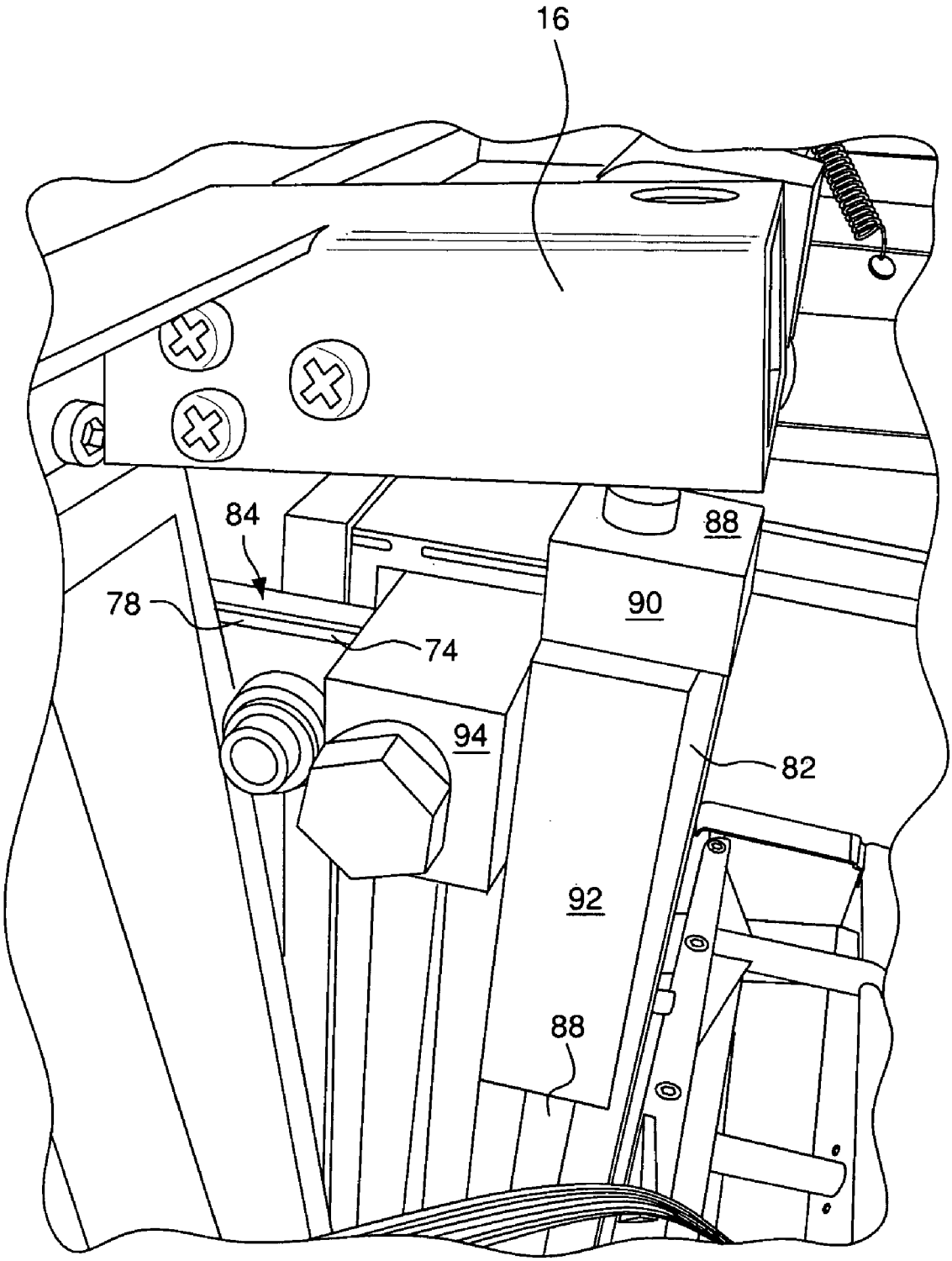
FIG. 11 is a partial perspective view of the vending apparatus of the newspaper vending machine of FIG. 9.

Referring to FIGS. 2 and 6A, the newspaper vending machine 10 includes a display for presenting a copy of the periodical loaded on elevator 20. The display includes a door 42 hingedly connected to front panel 32 and carrying a transparent panel 44 for viewing the display copy. The display also includes a holder 46 receiving the display copy and holding the display copy in position against or adjacent to the transparent panel 44. A door return spring 47, preferably a torsion spring, is located adjacent a lower end of the front door 42 for returning the door 42 to a closed position following removal of the display copy from vending machine 10.

Referring to FIGS. 6A through 8, vending machine 10 includes a door latching mechanism 48 that keeps front door 42 closed and latched until all newspapers have been dispensed from the elevator 20. The door latching mechanism 48 includes a catch rod 50 secured to the front door 42 and a trap bar 52 pivotably mounted to the carriage frame 16. The trap bar 52 has opposite legs 54 each including a notch 56 in which the catch rod 50 is received. The trap bar 52 is pivotally connected to a C-shaped support bracket 58 so as to permit pivotal movement about point A (FIG. 6B). The pivotal movement permits the trap bar 52 to release the catch rod 50, thus unlocking the door. A door release mechanism, described in greater detail below, engages a center leg 60 of trap bar 52 to pivot the trap bar for releasing the door 42. A suitable pivot connection between the trap bar 52 and the support bracket 58 could be made by bolting the opposite trap bar legs 54 to a pair of support angles 62 secured to opposite legs of the C-shaped bracket 58. The C-shaped bracket 58 is secured to the carriage frame 16 by bolts 64 (FIG. 15) engaging openings 66 in the center leg of the C-shaped bracket 58.

A compression spring 68 or similar biasing element is located between the front door 42 and the carriage frame 16 to urge the front door 42 open when the trap bar 52 is pivoted to release the catch rod. A pair of trap bar return springs 70 are attached to the trap bar 52 to urge the trap bar 52 downwardly for engagement with the catch rod 50 on the front door 42. Those skilled in the art will appreciate that the latching mechanism 48 described above is one way for releasably engaging the door to the frame 16, and that other mechanisms could be substituted for the disclosed embodiment.

Referring to FIGS. 9 through 14, the newspaper vending machine 10 includes an actuator arm 74 connected to a dispensing sled 76 (FIG. 15) for actuation of the vending machine 10 (e.g., dispensing of a periodical) by a user as described below in greater detail. The actuator arm 74 includes a bar 78 extending through a slot formed in the front panel 32 and a knob 80 secured to one end of the bar 78 to facilitate grasping of the actuator arm 74 by a user. The opposite end of the bar 78 is attached to a plate portion 84 of a linear slide 82. The linear slide 82 includes at least one, and preferably two, linear bearings 86 slidingly received on a substantially vertical guide rod 88. The guide rod 88 is supported at opposite ends by rod supports 90 secured to the carriage frame 16.

The bearings 86 of the linear slide 82 are contained within a housing portion 92 of the linear slide 82. The linear slide 82 also includes a sled attachment portion 94 located between the plate portion 84 and housing portion 92 for attachment of the dispensing sled 76 to the linear slide 82. The use of linear bearings 86 translating on guide rod 88 to direct the dispensing sled 76 along a substantially vertical path provides for smoother actuation of the dispensing assembly of newspaper vending machine 10 by a user compared to sled translation using wheels rolling within guide rails, such as in the newspaper vending machine of the '719 patent. The vertical translation of actuator arm 74 provided by linear slide 82 requires a shorter actuation stroke than the actuation arm of the '719 patent, which is pivotably connected to the back of the housing for actuation along an arced path. It is contemplated that the actuation arm could be eliminated and that motor driven actuators, such as linear actuators, could be attached to the sled. In such an embodiment, the actuators would be activated upon receipt of sufficient payment, dispensing an article from the machine and then retracting back to the initial position. Alternately, the actuation arm could extend from a slot in the side of the housing.

Figure 12:
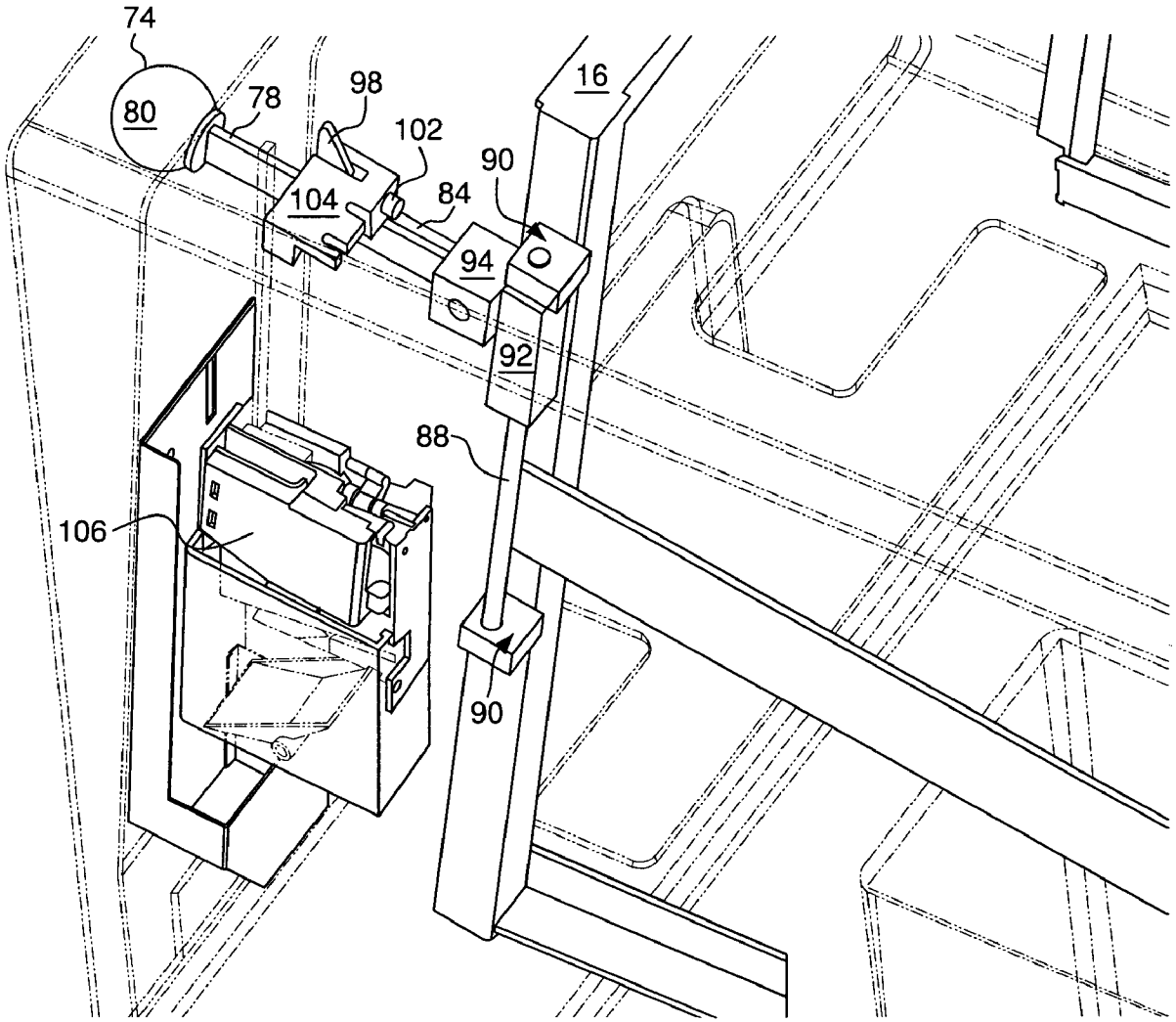
FIG. 12 is a partial rear perspective view of the vending apparatus of the newspaper vending machine of FIG. 9 with a portion of the vending apparatus shown in phantom for clarity of view, an actuator arm of the vending apparatus shown in an upper position.
Figure 13:
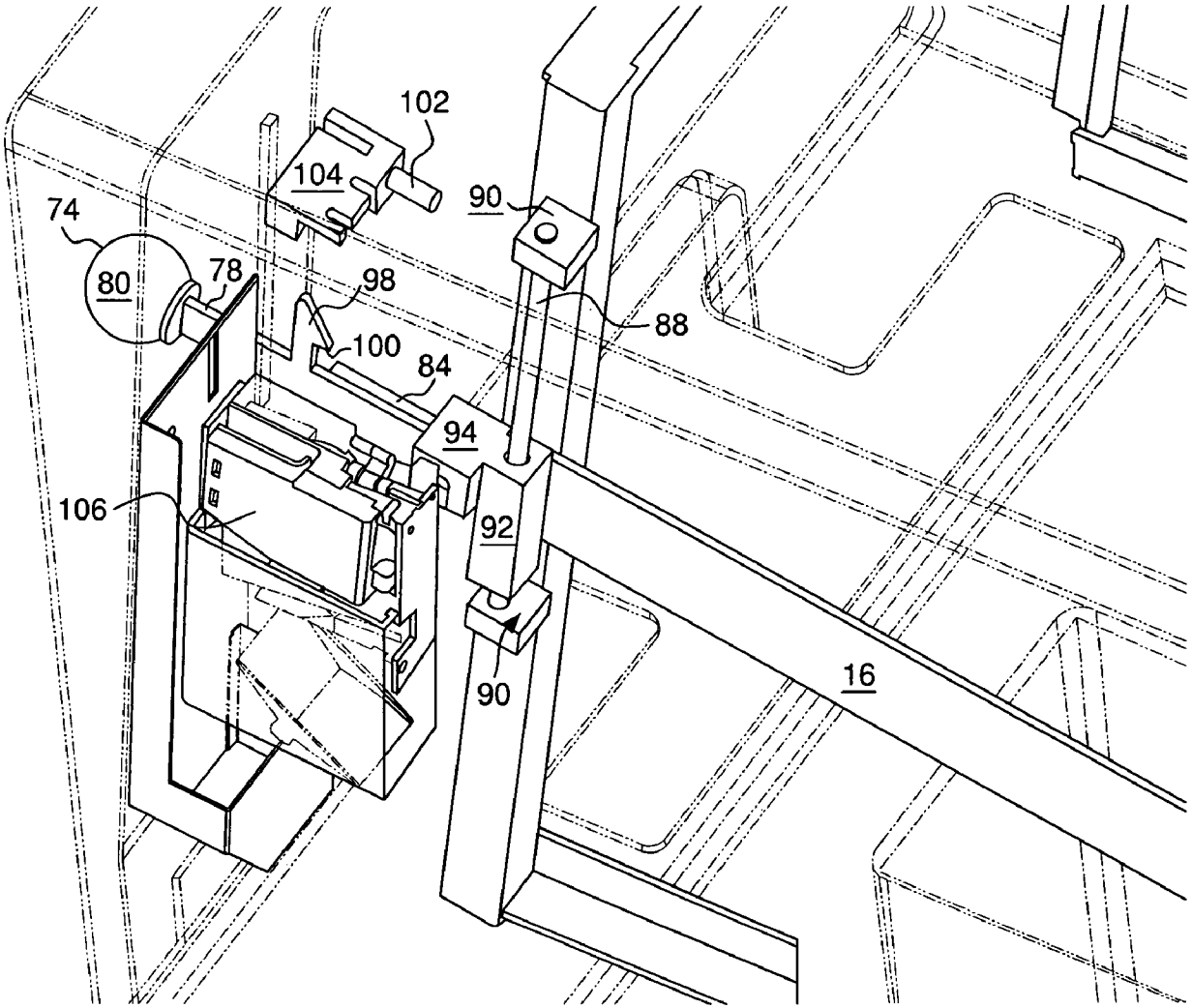
FIG. 13 is a partial rear perspective view of the vending apparatus of FIG. 12, the actuator arm shown in a lower position.

Referring to FIGS. 12 and 13, the newspaper vending machine 10 includes an arm locking mechanism 96 to prevent actuation of the arm 74 unless a requisite amount of coins are deposited. A lock tab 98 extending from an upper edge of bar 78 of actuator arm 74 includes a notch 100 adapted to receive a lock pin 102 in the locked position shown in FIG. 12. The engagement between the lock pin 102 and the notch 100 of tab 98 in this position prevents downward movement of the arm 74 and actuation of the dispensing assembly.

The lock pin 102 of arm lock mechanism 96 is slidably carried by lock housing 104, which is located at the upper end of the travel path for the actuator arm 74. A coin mechanism 106 is secured to the front panel 32 and is adapted to receive coins through a slot in the front panel. The coin mechanism 106 includes a linkage (not shown) connected to the lock pin which engages and disengages the pin with the notch 100 in tab 98. Any conventional coin mechanism 106 can be used in the present invention for engaging and disengaging the pin. Furthermore, a variety of other locking mechanism can be used to lock the actuation arm. The locking mechanisms and coin mechanisms specifically described n the '719 patent offer forms of suitable devices that can be readily used in the present invention. U.S. Pat. No. 6,279,719 is incorporated herein by reference in its entirety. In the unlocked position of the arm lock mechanism 96, the lock pin 102 is retracted from the notch 100 of tab 98, thereby allowing downward movement of the actuator arm 74 as shown in FIG. 15.

Referring to FIG. 15 through 18, the dispensing sled 76 of newspaper vending machine 10 is shown. The dispensing sled 76 includes a pair of pointed contact fingers 108 adapted to engage a newspaper on a stack of newspapers loaded onto the elevator 20 and directing the newspaper downwardly towards an exit path below the contact fingers. The contact fingers 108 are carried by finger mounts 115 pivotably supported on an upper rod 110. The upper rod 110 extends between opposite plates 112 each secured to an elongated guide block 114. The dispensing sled 76 also includes a lower rod 117 extending between the plates 112.

Figure 20:
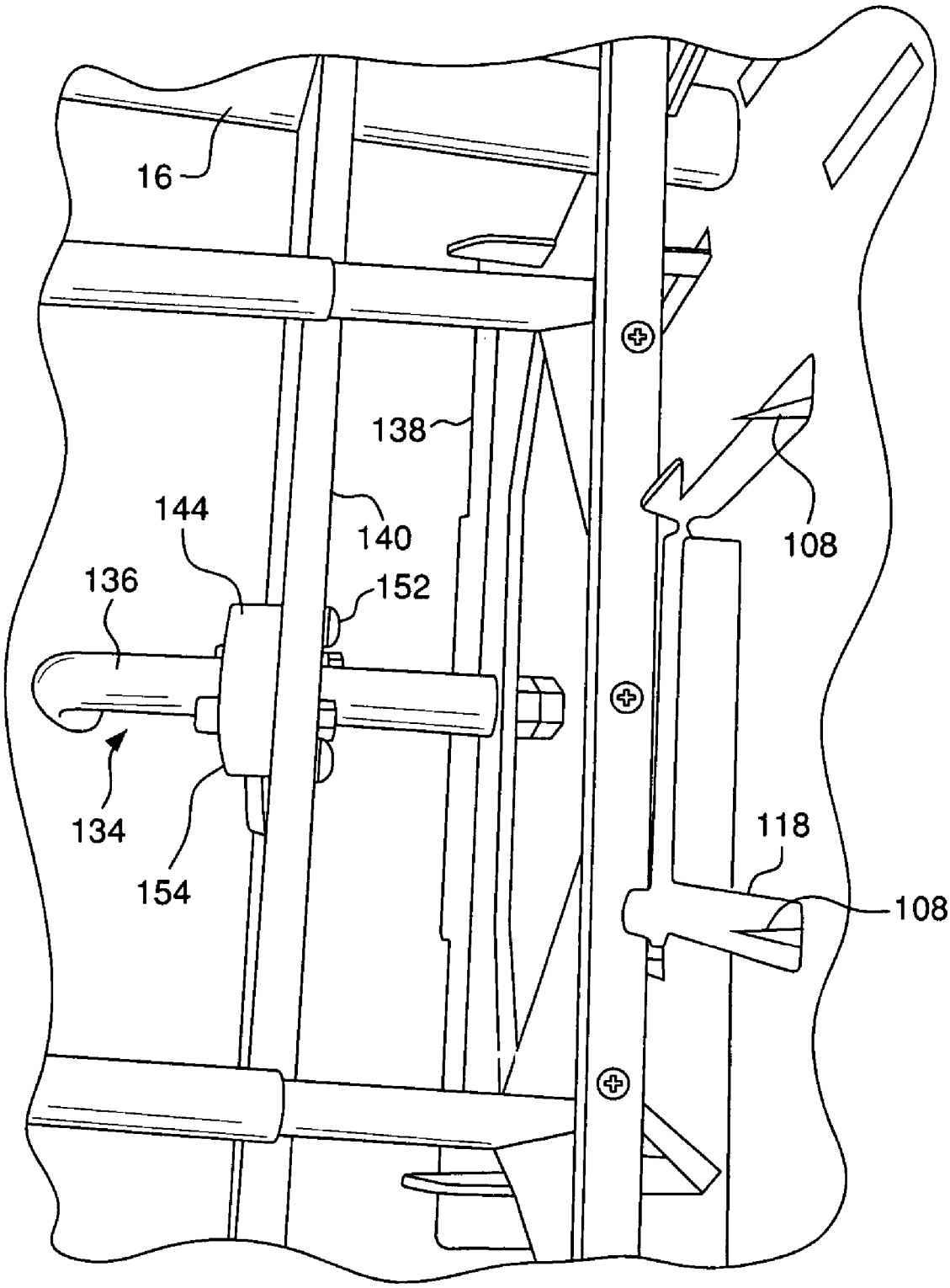
FIG. 20 is a top perspective view of a portion of the vending apparatus of a newspaper vending machine including an exit path adjustment mechanism according to the invention.

The guide (bearing) blocks 114 have central bores 116 providing for sliding of the guide blocks 114 along guide bars secured to the carriage frame 16. The blocks 114 may also or alternatively include roller bearings to facilitate sliding. The dispensing sled 76 is secured to the sled attachment portion 94 of the linear slide 82 (FIG. 11) for substantially vertical translation of the sled 76 with the actuator arm 74 as described above. The dispensing sled 76 is secured to the linear slide 82 such that the contact fingers 108 extend rearwardly towards the elevator 20. As shown in FIG. 20, the contact fingers 108 preferably extend through a slot in a fixed wall 118 located between the dispensing sled 76 and the elevator 20.

Figure 18:
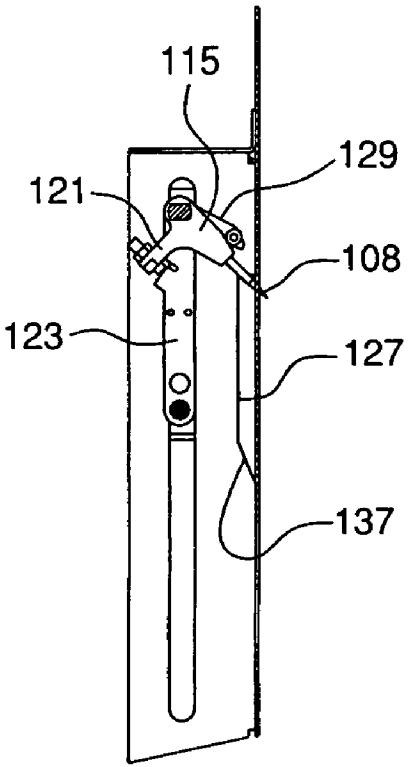
FIGS. 17 and 18 are respectively front and side views of the dispensing sled of FIGS. 15 and 16 mounted on a wall of the vending apparatus of FIGS. 9 through 13.
Figure 17:
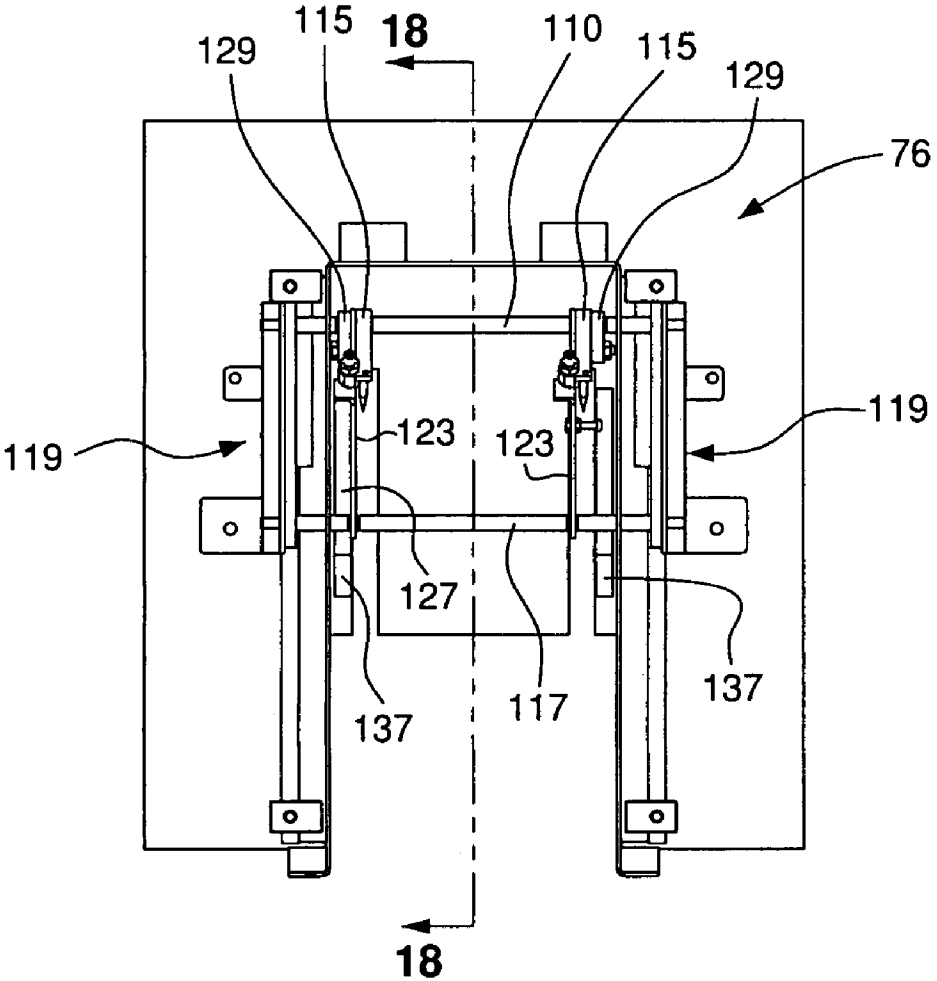

Referring to FIGS. 17 and 18, the dispensing sled 76 is shown slidably mounted on slide assemblies 119 secured to the fixed wall 118. Each of the finger mounts 115 includes a counterbalance arm 121 that is arranged to provide for pivoting of the finger mount 115 under gravity forces to an extended position, as shown in FIGS. 15D and 18 when the finger mount 115 is not otherwise constrained in the manner described in greater detail below. In the extended position for the finger mount 115, the associated contact finger 108 extends through the slot in the fixed wall 118. The dispensing sled 76 also includes brackets 123 received on the upper and lower rods 110, 117 adjacent the finger mounts 115. Each of the brackets 123 supports a stop plate 125 oriented to contact the associated finger mount 115 and limit the amount of extension of the contact finger 108 to that shown in FIG. 18. An adjustment screw mounted on the counterbalance arm 121 contacts the stop plate 125 and is designed to permit adjustment of the fingers.

As shown in FIGS. 17 and 18, the newspaper vending machine 10 may include a pair of ramps 127 extending in a substantially vertical orientation adjacent the dispensing sled 76. As shown in FIG. 17, the ramps 127 are offset slightly with respect to the associated finger mount 115 so as not to impede the pivoting of the contact finger 108 to its extended position. The ramps 127, however, are located sufficiently near to the finger mounts 115 to provide for engagement between the ramps and actuators 129 mounted on the upper rod 110 next to the finger mounts 115.

Figure 15A:
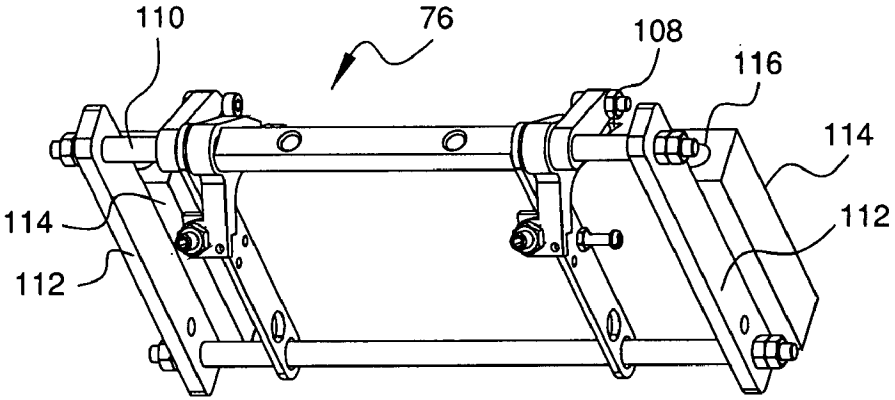
FIGS. 15A through 15D are views of a dispensing sled of the newspaper vending machine of FIGS. 9 through 13.
Figure 15B:
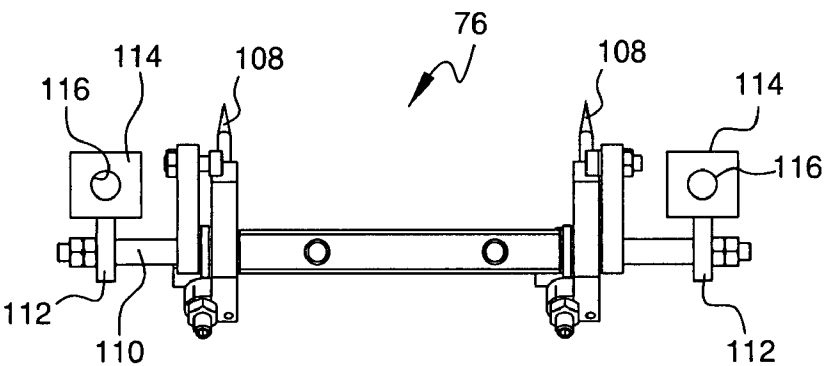
Figure 15C:
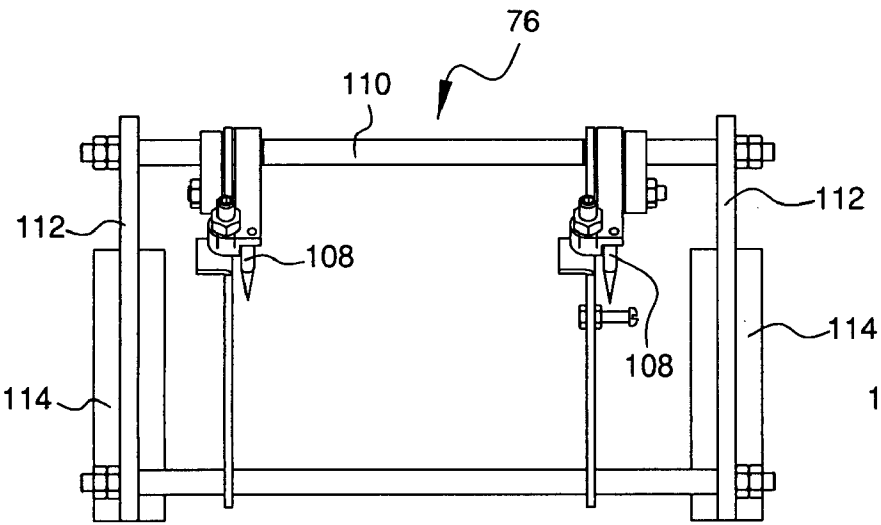
Figure 15D:
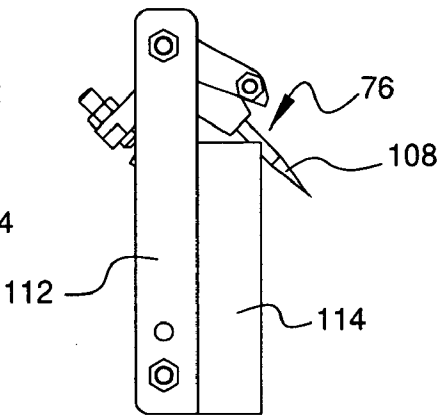
Figure 16:
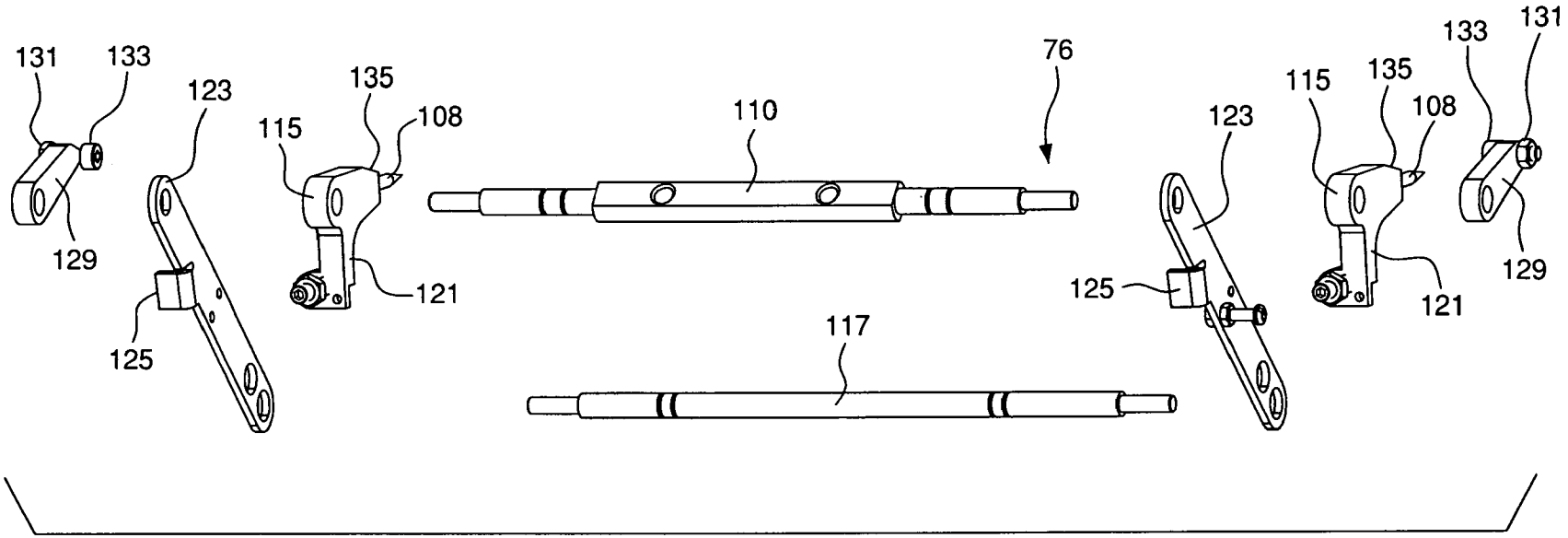
FIG. 16 is an exploded perspective view of the dispensing sled of FIG. 15.

Each of the actuators 129 includes a fastener, such as a hex nut 131 and cap screw 133 adjacent an end such that the head of the cap screw 133 is located for contact with an angled surface 135 of the associated finger mount 115 as shown in FIG. 15B. Each actuator 129 is free to pivot with respect to the upper rod 110, and is in contact with the angled surface 135 of the associated finger mount 115 when the contact finger is extended as shown in FIG. 18 (engagement position). The dispensing sled 76 is shown in FIG. 18 at the upper end of its travel path. As shown, the terminal end of the actuator 129 is located such that it will contact the upper end of the ramp 127 during the downward travel of the dispensing sled 76. The contact of the actuator 129 with the upper end of the ramp 127 will cause the actuator 129 to pivot upwardly (counterclockwise in FIG. 18) with respect to the finger mount 115 during the downward movement of the sled 76. The finger mount 115, however, will remain in the same angular orientation shown as the sled 76 is moved downwardly.

Each ramp 127 includes an inclined surface 137 at its lower end that is located sufficiently above the lower end of the travel path for the finger mounts 115 such that the actuators 129 no longer contact the ramp 127 and are free to drop back down into contact with the finger mounts 15. In this position, the finger mounts 115 and actuators 129 will be located at the lower end of the travel path in the same angular orientation with respect to each other as they are at the upper end of their travel path shown in FIG. 18. Positioned in this manner, the terminal ends of the actuators 129 will again contact the inclined surface 137 of the ramps 127 during the upward travel of the sled 76 as it is returned to its upper position.

When the actuator ends contact the ramp during upward movement of the sled 76, the actuators 129 will force the finger mounts 115 to pivot downward (clockwise in FIG. 18) moving the contact fingers 108 to a retracted position with respect to newspapers that are loaded on the elevator 20. With the fingers 108 in the retracted position, the sled is free to move up. As soon as the ends of the actuators 129 pass the upper ends of the ramps 127, the gravity forces applied by counterbalancing arms 121 will again pivot the finger mounts 115 to the extended position shown in FIG. 18. The retracting feature provided by this construction desirably prevents contact between the newspapers and the pointed contact fingers 108 during the upward return of the sled 76, thereby limiting damage of the newspapers by the contact fingers 108. The retracting feature also ensures that the dispensing sled 76 must be fully returned to its upper position, in which the actuator arm 74 is locked, before the contact fingers 108 engage another newspaper.

Figure 19:
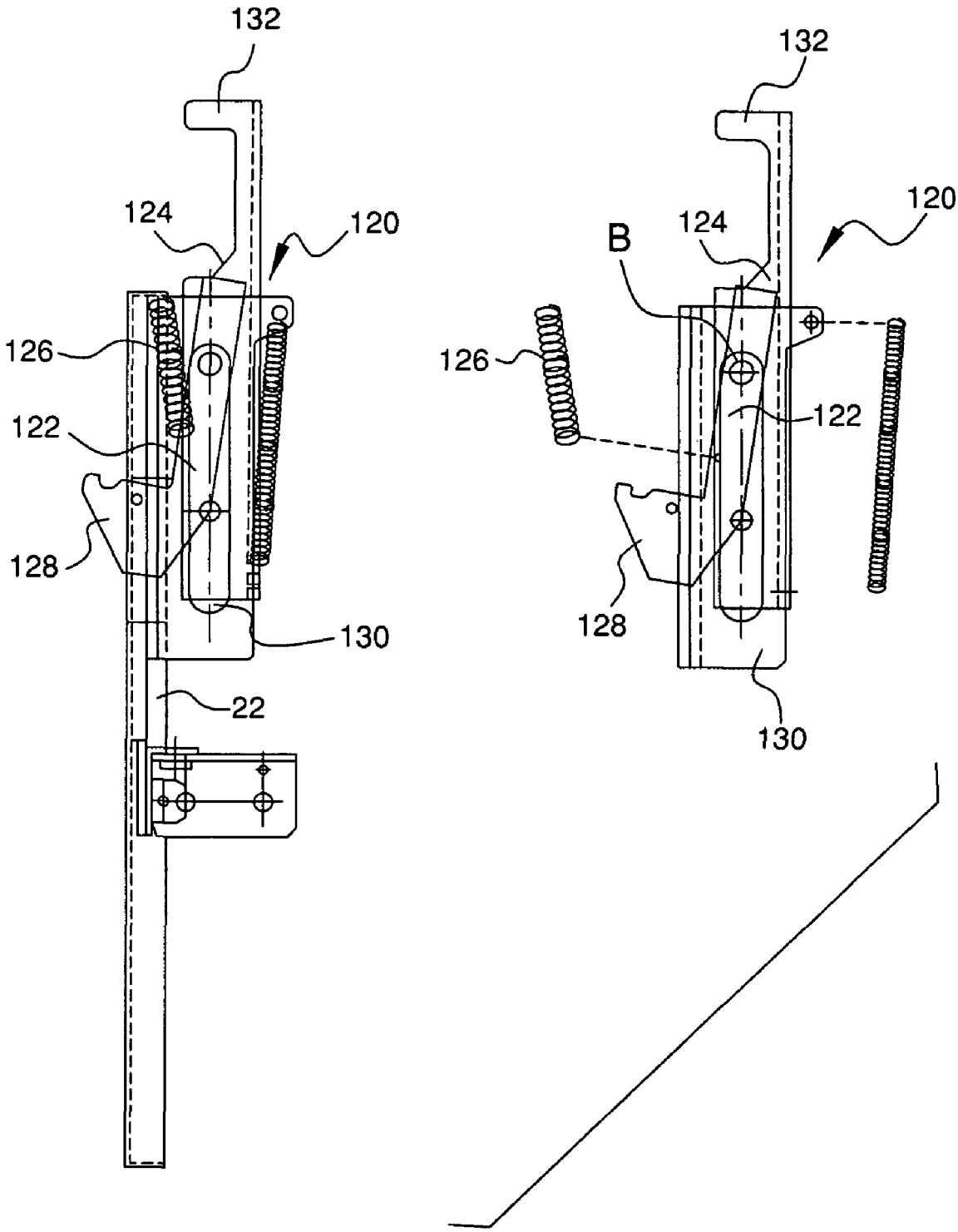
FIG. 19 are side views of a display door release mechanism of the newspaper vending machine according to the invention.

Referring to FIG. 19, the newspaper vending machine includes a door release mechanism 120 for unlocking the front door 42 from its latched condition, when all of the newspapers loaded onto the elevator 20 have been delivered from the machine 10 by the dispensing sled 76. As described above, the unlatching of the front door 42 in this manner provides access to the display for removal of the display copy of the newspaper by a user of machine 10.

The door release mechanism 120 includes a hook plate 122 and a catch plate 124 pivotably connected to each other at B. A spring 126 is connected to the hook plate 122 and to the catch plate 124 to bias the hook plate 122 such that a notched portion 128 of the hook plate 122 extends through a slot in the base 22 of elevator 20. As long as there are newspapers on the elevator, the hook plate 122 will be retracted with respect to the base 22.

The hook plate 122 and catch plate 124 of the door release mechanism 120 are translatably supported on a guide track 130. The guide track 130 is secured to the base 22 of elevator 20 such that the guide track 130 moves with the elevator 20. The guide track 130 provides for substantially vertical translation of the hook plate 122 and catch plate 124 with respect to the elevator base 22. The catch plate 124 extends upwardly from the hook plate 122 to a hooked end 132 of the catch plate 124. The hooked end 132 of the catch plate 124 is located for engagement with the center leg 60 of the above-described trap bar 52 when the elevator 20 has been moved to a forward, empty position.

When the elevator 20 is emptied of newspapers, the spring 126 urges the notched portion 128 of the hook plate 122 to extend through the slot in the elevator base 22, as shown in FIG. 19. In this position, the notched portion 128 of the hook plate 122 is located for engagement with the dispensing sled 76, preferably by a tab (not shown) secured to the dispensing sled structure supporting one of the contact fingers 108. Downward movement of the dispensing sled 76 with the door release mechanism 120 engaged in this manner causes the catch plate 124 to pivot the trap bar 52 thereby releasing the front door 42, which is then opened by the action of the compression spring 68. The engagement between a tab secured to the dispensing sled desirably protects the contact fingers 108 compared to the door release system disclosed in the '719 in which the contact fingers themselves engage wires to release the front door.

Although the front door 42 is shown in some of the drawings with a handle on the outside of the door to facilitate opening, it is contemplated that the compression spring 68 could be adapted to open the door sufficiently without a handle on the door 42 being needed. It is further contemplated that the door return spring 47 could be arranged such that its unrestrained condition is associated with a partially opened position for the front door 42. Arranged in this manner, the door return spring 47 would assist the compression spring 68 in opening the door from the closed door position to the partially-opened door position. After a user has fully opened the front door 42 to remove the display copy, and has released the door, momentum of the moving door created by the door return spring 47 will cause it to move through the partially-opened door position to the closed door position where it is locked by the door latching mechanism 48.

Figure 21C:
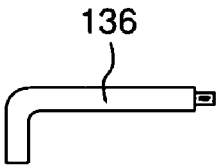
FIGS. 21A through 21C are views of a locking mechanism for the exit path adjustment mechanism of FIG. 20.
Figure 21B:
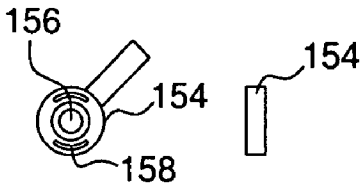
Figure 21A:
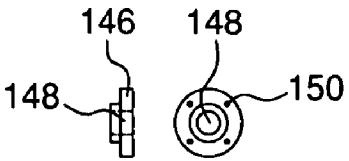

Publications such as newspapers vary in thickness from day to day. Accordingly, newspaper vending machines are known to include exit path adjustment mechanisms to vary the width of a newspaper exit path below the dispensing assembly for accommodating changes in publication thickness. Referring to FIGS. 4, 20 and 21, the newspaper vending machine 10 includes an improved exit path adjustment mechanism 134 including a draw bar 136 attached to a translatably supported exit wall 138. The draw bar 136 is also slidably received by an opening 142 in a fixed support member 140. Movement of the draw bar 136 with respect to the support member 140 moves the exit wall 138 towards or away from the dispensing assembly of the newspaper vending machine 10. A graduated scale (not shown) is preferably located on the carriage frame 16 adjacent the newspaper exit path to facilitate adjustment of the exit path width.

The vending machine 10 also includes an exit wall locking mechanism 144 secured to the fixed support member 144 adjacent the draw bar opening 142. The locking mechanism 144 is adapted for engagement with the draw bar 136 of the exit path adjustment mechanism. The exit wall locking mechanism 144 includes a first disc 146 having a central opening 148 for receiving the draw bar 136 and four smaller openings 150 spaced radially from the central opening 148. The smaller openings 150 receive pins or bolts 152. A second disc 154 includes a central opening 156 receiving the draw bar 136 and slotted openings 158 receiving the pins or bolts 152 from the first disc 146. The second disc 154 is rotatable with respect to the first disc 146 and is eccentrically arranged such that, depending on the position of the second disc 154 with respect to the first disc 146, the second disc 154 will either be engaged or disengaged with respect to the draw bar 136 to respectively prevent or allow movement of the draw bar.

Although the drawings illustrate a coin mechanism, it should be readily apparent that a bill validator in addition to or instead of the coin mechanism could be included in the vending machines.

While the above description has referred to the application of the present invention for dispensing newspapers, it is contemplated that the machine can be used to dispense any suitable periodical, including magazines.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A vending machine for dispensing a periodical such as a newspaper, the vending machine comprising:

a housing including a top wall, a bottom wall, a back wall and side walls;

a display assembly including a door hingedly connected to a front panel, the door including a transparent panel for displaying a copy of the periodical being dispensed by the vending machine;

a frame movably disposed within the housing;

an elevator assembly including a base mounted so as to be slidable with respect to the frame for moving from a rearward position with respect to the frame to a forward position, the elevator adapted to support a stack of periodicals during use;

a dispensing assembly mounted to the frame forwardly of the base, the dispensing assembly including a dispensing sled translatable with respect to the frame between an upper position and a lower position, the dispensing sled adapted to engage a forwardly located periodical of the stack of periodicals for dispensing the periodical from an exit area of the vending machine;

an actuation arm attached to the dispensing sled such that the arm is translated along a substantially vertical path as the dispensing sled is moved between its upper and lower positions, the actuation arm projecting outwardly from the front panel to provide for actuation of the dispensing assembly by a user of the vending machine;

an actuation arm locking mechanism engaging the actuation arm, the actuation arm locking mechanism having locked and unlocked conditions for respectively disabling and enabling the actuation of the dispensing assembly by a user; and a door locking assembly engaging the display door and adapted to prevent access to the display copy of the periodical until the last copy of the periodical loaded onto the elevator has been dispensed; and a linear slide assembly including a guide rod secured to the frame to extend substantially vertically and a slide body slidably received on the guide rod, the actuation arm of the vending machine attached to the slide body of the slide assembly for translating the actuation arm along the substantially vertical path.

2. The vending machine according to claims 1, wherein the linear slide assembly further includes at least one linear bearing slidably received on the guide rod of the linear slide assembly, each of the at least one linear bearing contained within a bore defined by the slide body.

3. The vending machine according to claim 1, wherein the slide body of the linear slide assembly includes an actuation arm attachment portion and wherein the actuation arm is attached to the actuation arm attachment portion of the slide body adjacent an end of the actuation arm.

4. The vending machine according to claim 1, wherein the slide body of the linear slide assembly includes a sled attachment portion and wherein the dispensing sled is attached to the sled attachment portion of the slide body for movement between the upper and lower positions of the dispensing sled.

5. The vending machine according to claim 1, wherein the frame of the vending machine is translatable with respect to the housing between a retracted position in which the housing is contained within an interior defined by the housing and an extended condition in which at least a portion of the frame extends beyond a front end of the housing.

6. The vending machine according to claim 5, wherein the vending machine further comprises a pair of rails secured to the bottom wall of the housing and at least one roller rotatably secured to each of the rails, and wherein the frame engages the engages the rollers for translation of the frame along the rails between the retracted and extended positions of the frame.

7. The vending machine according to claim 5, further comprising a retainer wire, the retainer wire attached at one end to the bottom wall of the housing, the retainer wire attached at an opposite end to the base of elevator such that a rearward end of the frame and the elevator base are drawn towards each other when the frame is translated along the rails between the retracted and extended conditions.

8. A vending machine for dispensing a periodical such as a newspaper, the vending machine comprising:

a housing defining an interior;

a frame movably disposed within the housing;

an elevator adapted for receiving a stack of periodicals to be dispensed from the vending machine and advancing the stack as each periodical is dispensed;

a linear slide assembly including a guide rod extending substantially vertically and at least one linear bearing slidably received on the guide rod, the linear slide assembly further including a slide body defining a central bore in which the at least one linear bearing is received;

a dispensing assembly including a dispensing sled operably attached to the slide body of the linear slide assembly for translation between upper and lower positions, the dispensing assembly adapted to engage a stack of periodicals loaded onto the elevator for dispensing the periodicals in single fashion as the dispensing sled is moved between the upper and lower sled positions; and an actuation arm attached to the slide body such the actuation arm defines a substantially vertical linear path during movement of the dispensing sled between the upper and lower sled positions, the actuation arm extending to an exterior location with respect to the housing for engagement by a user of the vending machine.

* * * * *